US007971755B2

(12) United States Patent
Faurie

(10) Patent No.: US 7,971,755 B2
(45) Date of Patent: Jul. 5, 2011

(54) CONTAINER FOR PACKAGING A LIQUID TO BE DISPENSED IN DROPS, REVERSIBLY DEFORMED BY AIR INPUT

(75) Inventor: Michel Faurie, Veyre-Monton (FR)

(73) Assignee: Laboratories Thea, Clermont-Ferrand (FR)

( * ) Notice: Subject to any disclaimer, the term of this patent is extended or adjusted under 35 U.S.C. 154(b) by 796 days.

(21) Appl. No.: 11/630,831

(22) PCT Filed: Jun. 24, 2005

(86) PCT No.: PCT/IB2005/001791

§ 371 (c)(1),
(2), (4) Date: Dec. 22, 2006

(87) PCT Pub. No.: WO2006/000897

PCT Pub. Date: Jan. 5, 2006

(65) Prior Publication Data

US 2008/0067194 A1 Mar. 20, 2008

(30) Foreign Application Priority Data

Jun. 24, 2004 (FR) ..... 04 07042

(51) Int. Cl.
*B67D 7/76* (2010.01)

(52) U.S. Cl. ..... 222/189.09; 222/189.06; 222/189.07; 222/213; 222/420; 222/422

(58) Field of Classification Search ..... 222/80, 222/81, 83, 153.06, 153.14, 212, 420, 422, 222/189.07, 421, 189.06, 542, 189.09, 209, 222/213–215

See application file for complete search history.

(56) References Cited

U.S. PATENT DOCUMENTS

| | | | | |
|---|---|---|---|---|
| 3,149,758 | A * | 9/1964 | Bush et al. | 222/189.09 |
| 3,189,223 | A * | 6/1965 | Mackal | 222/1 |
| 4,938,389 | A | 7/1990 | Rossi et al. | |
| 4,948,505 | A * | 8/1990 | Petrucci et al. | 210/238 |
| 5,105,993 | A * | 4/1992 | La Haye et al. | 222/189.09 |
| 5,249,712 | A * | 10/1993 | Lontrade et al. | 222/189.08 |
| 5,310,085 | A | 5/1994 | Lontrade et al. | |
| 5,310,094 | A | 5/1994 | Martinez et al. | |
| 5,320,254 | A * | 6/1994 | Ranalletta et al. | 222/189.08 |
| 5,490,938 | A * | 2/1996 | Sawan et al. | 210/651 |
| 5,588,559 | A * | 12/1996 | Vallet Mas et al. | 222/92 |
| 5,611,464 | A * | 3/1997 | Tsao et al. | 222/189.06 |
| 5,680,969 | A * | 10/1997 | Gross | 222/494 |

(Continued)

FOREIGN PATENT DOCUMENTS

FR 2770495 A 5/1999

(Continued)

*Primary Examiner* — Frederick C. Nicolas
(74) *Attorney, Agent, or Firm* — Millen, White, Zelano & Branigan, P.C.

(57) ABSTRACT

The invention concerns a container for packaging a liquid (1) to be dispensed in drops. The container is reversibly deformable by air input and is equipped with a head (3) for dispensing liquid through a nozzle (5). The dispensing head (3) comprises a recessed body (4) which is nested inside a neck (10) of the container and which holds a hydrophobic microporous pad (8) arranged upstream of a chamber (9). Chamber (9) is provided with an air reservoir for preventing the liquid from passing through the microporous pad (8) between two liquid dispensing operations, when the nozzle (5) is sealingly obstructed with a cap (6), and for drying a partly hydrophilic and hydrophobic filtering membrane (7) arranged in the dispensing head (3).

24 Claims, 1 Drawing Sheet

U.S. PATENT DOCUMENTS 5,839,626 A * 11/1998 Gross et al. ..... 222/494
5,992,692 A * 11/1999 Boissay ..... 222/83
5,992,701 A * 11/1999 Bougamont et al. ..... 222/189.06
6,145,707 A * 11/2000 Baudin ..... 222/189.09
6,290,108 B1 * 9/2001 Gross ..... 222/494
6,336,571 B1 * 1/2002 Chibret et al. ..... 222/189.09
6,672,479 B2 * 1/2004 Shiraishi et al. ..... 222/105
6,708,850 B2 * 3/2004 Uetake et al. ..... 222/189.06
7,186,045 B2 * 3/2007 Gueret ..... 401/130
7,427,355 B2 * 9/2008 Chau ..... 210/266
2004/0074925 A1 4/2004 Faurie

FOREIGN PATENT DOCUMENTS

FR 2816600 A 5/2002

* cited by examiner

CONTAINER FOR PACKAGING A LIQUID TO BE DISPENSED IN DROPS, REVERSIBLY DEFORMED BY AIR INPUT

The invention is of the field of the packaging and dispensing of liquids, such as pharmaceutical solutions, particularly eye drops. The subject of the invention is a container equipped with a dispensing head, which is organized to contain a liquid, while at the same time protecting it from the external environment, and to deliver this liquid in a controlled manner, particularly drop by drop.

Containers for containing a liquid which are organized to preserve this liquid from the external environment and to deliver it in a controlled manner, particularly drop by drop, are known. The applications of such containers are numerous, and a favoured application, although this is non-restricting as far as the scope of the present invention is concerned, lies in the keeping and dispensing of a pharmaceutical solution, particularly eye drops.

With regard to the preserving of the liquid, this liquid needs to be protected from the external environment by preventing it from coming into contact with the ambient air which is likely to contain contaminants, particularly bacteria. To dispense the liquid, it is common practice to give the container a deformable nature allowing its volume to be reduced, at least temporarily, so as to discharge the liquid it contains. Such containers are more specifically flexible-walled containers, so that the liquid can be expelled as a result of compression exerted by the user on these walls, and are equipped with a dispensing head in order to achieve the two-fold objective of preserving and of dispensing the liquid in a controlled manner.

However, the solutions provided for specifically achieving one and other of these objectives are likely to be antagonistic, and designers in the field in particular concentrate their efforts on the search for a compromise between the various solutions. Consideration has also to be given to the fact that the container is desired to have a simple structure, the cost of production of which must not be prohibitive given its consumable nature, and that it must be convenient for the user to use.

It will be noted at this stage of the description that it is common practice within this field to use a filter membrane to prevent contaminants from passing from outside the container towards the liquid it contains. This membrane, placed near a nozzle of the dispensing head for discharging the liquid from the container, allows the liquid to pass through it under the effect of the compression exerted in the container by the deformation of the walls.

In a first approach, it has been proposed for the container to be given an irreversible or almost irreversible deformable nature. An internal wall of the container delimiting the volume in which the liquid is housed is organized as a bellows, and is encased in an outer sheath. The container also comprises a filter membrane which has an air-impermeable nature so as to prevent external air from being admitted towards the liquid contained in the container under the effect of shrinkage by liquid delivered. Reference may, for example, be made to Patent Documents FR 2 661 401 and FR 2 770 495 (or U.S. Pat. No. 6,336,571) which describe such containers.

There then arises the problem of the controlled delivery of the liquid. According to document FR 2 770 495 (U.S. Pat. No. 6,336,571), a microporous pad regulating the flow of liquid is positioned in the dispensing head of a container the walls of which are strictly irreversibly deformable. An intermediate reverse is formed downstream of the pad and upstream of a filter air-impermeable membrane. Such a container has a complex structure, and the cost of production, of the reservoir containing the liquid to be delivered as well as of the dispensing head, is high. Furthermore, it is not possible with such a container the walls of which are irreversibly deformable to deliver all the liquid contained in the reservoir. Indeed, the belows form does not allow to expulse the very last drops, so that part of the liquid is wasted.

In the second approach, it has been proposed for the container to be given a reversible deformation facility, the membrane for its part being air-permeable. Reference may, in particular, be made to document FR 2 816 600 (or US 2004/0074925) which describes such a container. The structure of the dispensing head of this container is simple. It contains a filter membrane being deemed to be sufficient to preserve the liquid against contaminants likely to be present in the ambient air. Furthermore, it is provided for the liquid to be strictly preserved from the ambient environment prior to first use. To achieve this, the dispensing head is mounted movably on the neck of the container so as to perforate a sealing disc extemporaneously at the time of the first delivery operation. However, the result of this arrangement, and more particularly, of the mobility of the dispensing head with respect to the container, is that there is a risk of a loss of leaktightness between the dispensing head and the container once the sealing disc has been perforated and the dispensing head has been assembled by the user inside a neck of the container, particularly as a close-fitting push-fit. While this risk can be reduced, such an approach tends to increase the complexity of the dispensing head, to the detriment of the benefit first sought of simplifying its structure. Furthermore, the residual presence of the sealing disc is likely to form an obstacle impeding the controlled delivery of the liquid.

As a result, the designers in this field are still faced with the need to reach a compromise between the simplicity of the dispensing head, the preserving of the liquid from contaminants which might be present in the ambient air, the ease with which the delivered liquid can be metered, and the optimal use of all the liquid contained in the reservoir.

The present invention falls within the scope of this search for a compromise and aims to propose a container for packaging a liquid that is to be dispensed drop by drop which offers a solution that addresses such a compromise. The invention falls more specifically within the scope of the packaging of a sensitive liquid, such as a pharmaceutical, biological or similar solution, particularly eye drops.

The inventive approach of the present invention has consisted in general in choosing first of all a container of the type comprising a reservoir the walls of which are reversibly elastically deformable through the intake of air into the container. This choice is aimed at allowing the liquid to be delivered under the effect of pressure exerted against these walls, and at allowing the container to return spontaneously to its initial shape after a dose of liquid has been delivered. Such a reservoir the walls of which are reversibly deformable has in itself the advantage of being highly simple to produce, with respect to the irreversibly deformable reservoirs of the prior art, which require a high number of components and of assembly operations.

In general, such a container according to the present invention would be recognized in that it is equipped with a dispensing head comprising a hollowed-out body which is equipped with a nozzle for delivering the liquid and which contains a microporous pad of hydrophobic material placed downstream of the reservoir across the body of the dispensing head. The said body is assembled irreversibly inside the neck of the container.

Furthermore, it is proposed for the container to be equipped with a removable cap for tightly sealing the nozzle which, combined with the said microporous pad made of hydrophobic material, impedes the spontaneous flow of the liquid from the volume of the container reserved for storing it towards the nozzle. These provisions are such that the spontaneous passage of liquid through the hydrophobic microporous pad is prevented when the cap is tightly sealing the nozzle, this being the case throughout the usage life of the container. Conversely, the free flow of the liquid from the volume of the container reserved for storing it, through the hydrophobic microporous pad, is allowed when the nozzle is uncovered, to allow the desired delivery of a dose of liquid through pressure exerted on the walls of the container. Furthermore, the passage of air is allowed by suction through the hydrophobic microporous pad towards the storage volume after a dose of liquid has been delivered, through the elastic return of the walls of the container allowing it to return to its initial shape in spite of the removal of a dose of liquid.

It will be noted that the microporous pad is preferably made of polyethylene or similar material which gives it a hydrophobic nature so that it cannot be wetted, its microporous nature nonetheless allowing the liquid to pass through it provided that the pressure differential brought about by the pressure exerted by the user is sufficient.

Such a configuration of the container according to the invention, and more particularly the combination of the reversibly deformable reservoir, the microporous pad and the sealing cap, is advantageous. Indeed, when the cap is put back in a position where it tightly seals the nozzle, after air intake following the delivery of a dose of liquid and the elastic return of the walls of the reservoir to their initial shape, there is created a pressure differential between the parts upstream and downstream of the pad through which there is created a head loss. This pressure differential prevents the liquid contained in the container from passing through the pad, even if the walls of the reservoir are accidentally pressed, and it ensures the tightness of the flask, together with protecting the liquid it contains from external contaminants. Furthermore, such a configuration prevents stagnation of the liquid downstream of the pad, since the liquid which has not been expulsed is succed back towards the volume of the container.

The container according to the invention advantageously addresses an objective of the invention, which is to ensure an optimal use of all the content of the container, in two different ways. On one hand, owing to its elastically reversibly deformable walls, the container keeps an intact ability to expulse the liquid until the last drop of liquid. Indeed, since some air is succed into the container in replacement of each dose of the liquid expulsed, the pressure available in the container for the expulsion is always the same all along use, and until the delivery of the last drop. On the other hand, as it has been described above, there remains upstream of the pad no drop of liquid which is likely to be contaminated by external contaminants, and which should be eliminated before any new delivery of a clean dose.

Furthermore, the microporous pad, through which is created a head loss, regulates the flow of liquid, thereby encouraging the controlled delivery of doses of liquid. Moreover, it prevents the liquid contained in the flask from flowing when the cap is removed, even when the flask is turned down, the dispensing head being directed downwards, as long as no pressure is exerted on the container walls.

In the context of an application of the container to a sensitive liquid, particularly a pharmaceutical solution, the dispensing head is preferably equipped with a filter membrane intended to protect the liquid from an intake of contaminants present in the ambient air, particularly bacteria. According to the invention, a membrane is chosen that is at least partially hydrophilic and at least partially hydrophobic, so as to allow alternately the liquid and the air to pass through it, and that is positioned in the dispensing head upstream of the nozzle, between the latter and the pad. The partially hydrophilic nature of the membrane allows the liquid to pass through it under the effect of the compression exerted in the container by deformation of the walls, whereas its partially hydrophobic nature allows an input of ambient air inside the container, when the latter elastically returns to its initial shape after each compression exerted by the user.

The membrane also advantageously constitutes an additional head loss which prevents, in combination with the hydrophobic microporous pad, any leak of liquid out of the container as long as no pressure is exerted on the container's walls.

In order to encourage the passage of the air through the membrane, the invention then anticipates for it to be possible for this membrane to be kept dry between two deliveries of liquid, when the container is standing on its base, by virtue of the presence of an intermediate chamber formed between the microporous pad and the membrane. Such an intermediate chamber may also be put to use to form a chamber to even out the delivery of the liquid. For this, it may advantageously be given sufficient volume that it can collect at least one drop of liquid that is to be dispensed during a liquid delivery operation so as to cause it to leave the dispensing head drop by drop.

The volume of the intermediate chamber also and advantageously constitutes a reserve of air, which, when the nozzle is sealed by the cap, maintains a pressure which tends to prevent the liquid from passing through the microporous pad. It will be noted that, in combination with the intermediate chamber, the hydrophobic nature of the microporous pad acts as an obstacle opposing the passage of liquid through it.

The intermediate chamber also and advantageously constitutes a volume for accommodating the liquid that has not yet passed across the membrane when pressure ceases to be applied to the walls of the container. For that, it is advantageous to ensure that the intermediate chamber extends over the entire surface of the membrane and that it is situated a sufficient axial distance away from it to encourage the drying out of the membrane as soon as the pressure exerted on the walls of the container ceases after a delivery of liquid and when this container is returned to its position of rest, standing on its base with the dispensing head uppermost. As a result, any residue of liquid, which, having not been expelled, remains contained in the intermediate chamber, does not succeed in wetting the membrane by capillarity. It will be noted that the hydrophobic nature of the microporous pad also encourages the drying out of the membrane.

Through its various characteristics, as mentioned hereinabove and as will be defined and described more fully hereinbelow, the invention has the advantage, on an industrial scale, of doing away with the complicated dynamic closure systems that were used earlier. By virtue of the measures provided by the invention, there is no need either for a sealing disc or any other tearable partition, or of a valve of some other form, or of a procedure for opening the bottle via translation or rotational movement of the dispensing head with respect to the reservoir container of liquid that is to be dispensed drop by drop.

Of particular note is the advantageous combination of the presence of the microporous pad of hydrophobic nature, the presence of the filter membrane and the presence of the intermediate chamber between these, which, together with the dispensing head, confer both the function of evening out the flow of liquid when the latter is being dispensed and a function of sealing and drying out the membrane in combination with the pressure of the air retained in the intermediate chamber as a result of the sealing of the cap onto the dispensing head.

A microporous pad that is entirely appropriate in the context of the invention has, for the passage of liquid in the longitudinal direction, microducts, the mean pore diameter of which ranges between 0.3 and 10 microns.

Such a range of values is, in particular, especially appropriate in the favoured field of application of the invention which is that of the keeping and dispensing of a pharmaceutical solution, particularly eye drops.

Furthermore, it ensures that the pad produces a sufficient head loss to isolate the membrane from the liquid contained in the container before the first use. Degradation of the membrane upon contact with the liquid is therefore advantageously prevented during the storage of the container before the first use.

Furthermore, it is entirely advantageous within the context of the invention for this microporous pad to be combined with a partially hydrophilic and partially hydrophobic membrane, the pore diameter of which is smaller than that of the pad, particularly ranging between 0.1 and 0.2 microns. There is thereby obtained improved tightness and flow regulation properties.

The membrane may be formed of a polymeric material, based for example on polyamide or polyether sulphone resin, which confers its hydrophilic nature. It is then given a partially hydrophobic nature by modifying its structure on part of its surface. Such a modification may be carried out in a classical way, for example by grafting in the presence of an radicalar reactions initiator. The treatment is advantageously carried out so as to confer to the membrane an hydrophobic nature on a median strip occupying 20 to 50 percent of its surface that is wetted during the delivery of liquid.

As a preference, the body is assembled inside the neck as a push-fit with close contact.

The body is preferably elastically deformable so that it can be forcibly introduced into the neck of the container, a centring member preferably being formed at the base of the body so as to facilitate such a forcible introduction. This centring member preferably consists of radial fins for joining, by push-fitting, the body of the dispensing head to the neck of the container, the fins delimiting open sectors between them.

To further encourage the sealing of the container and the introduction with close contact of the body into the neck of the container, the exterior surface of the body of the dispensing head is advantageously equipped with a peripheral ring originating from the said body of which it forms an integral part, this ring preferably being in a plurality and axially repeated along the body.

It will be noted that the body is advantageously obtained by moulding under conditions such that a ring, originating from the parting line, is radial to the overall line along which it extends and, in particular, as appropriate, parallel to the abovementioned peripheral ring. This ring resulting from the parting line is more particularly situated at the distal end of the body, at the boundary where the centring member is attached, so as to encourage the best possible seal between the dispensing head and the container.

The removable cap, for its part, is preferably screwed onto the container so as to encourage the firm holding of the cap on the dispensing head and therefore the sealing between these two items.

To this end, the cap advantageously comprises a combination of sealing members combining a pip that penetrates the nozzle of the dispensing head and a skirt fitting over this nozzle. The pip and the skirt advantageously stem from the cap, when the latter is being obtained as a single piece, particularly by moulding.

BRIEF DESCRIPTION OF THE DRAWINGS

The present invention will be better understood from reading the description thereof which will be given in conjunction with the figures of the attached plate, in which:

In FIGS. 1 and 2, a container for packaging a liquid 1 has spontaneously reversible deformation so as to allow liquid 1 to be dispensed from manual compression exerted by a user on its walls 2 and spontaneous return to its initial shape by the admission of air. This container forms a volume 15 for storing the liquid 1 and is equipped with a dispensing head 3 for dispensing the liquid drop by drop. This dispensing head 3 mainly consists of a hollowed-out body 4 equipped with a nozzle 5 and with a removable cap 6 sealing the nozzle 5. A filter membrane 7 which is antibacterial, partially hydrophilic and partially hydrophobic, therefore permeable to air but also to the liquid, is positioned upstream of the nozzle 5 to protect the liquid from the undesirable ingress of contaminants that might be present in the ambient air, particularly bacteria.

Figure 3:
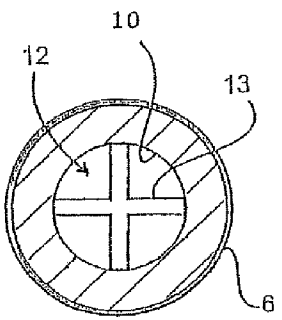
FIG. 3 is a view in section of the container illustrated in FIG. 2, the section being taken radially in the region of a centring member that the latter comprises.

The body 4 of the dispensing head 3 houses, within its interior recess, a microporous pad 8 which is made of a hydrophobic material, particularly polyethylene, so as to prevent liquid 1 from passing towards the nozzle 5 when there is no compression exerted on the walls 2 of the container. This microporous pad 8 is positioned upstream of and some distance from the membrane 7 so as to form an intermediate chamber 9 between itself 8 and this membrane 7.

The chamber 9 extends over the entire surface of the pad so as to constitute a reserve of air which, when the nozzle 5 is sealed by the cap 6, exerts pressure over the entire surface of the pad 8 preventing the liquid 1 from passing through the microporous pad 8 when the nozzle 5 is sealed by the cap 6. More specifically, the cap 6 impedes the discharge of air from the container and more particularly from the intermediate chamber 9. As the air is confined downstream of the microporous pad 8, the latter impedes the passage of the liquid 1 through it as long as the nozzle 5 is sealed by the cap 6. Conversely, in order to deliver liquid 1, the microporous pad 8 does not impede this delivery provided air can be discharged from the container through the nozzle 5. The intermediate chamber 9 is put to use to spontaneously even out the flow of liquid 1 through the microporous pad 8 prior to its being dispensed through the nozzle 5.

The intermediate chamber 9 extends over the entire surface of the membrane so as to form a volume for collecting the liquid 1 away from the membrane 7 when pressure ceases to be exerted on the walls 2 of the container and thus encourage the drying-out of the membrane between two deliveries of liquid.

Figure 2:
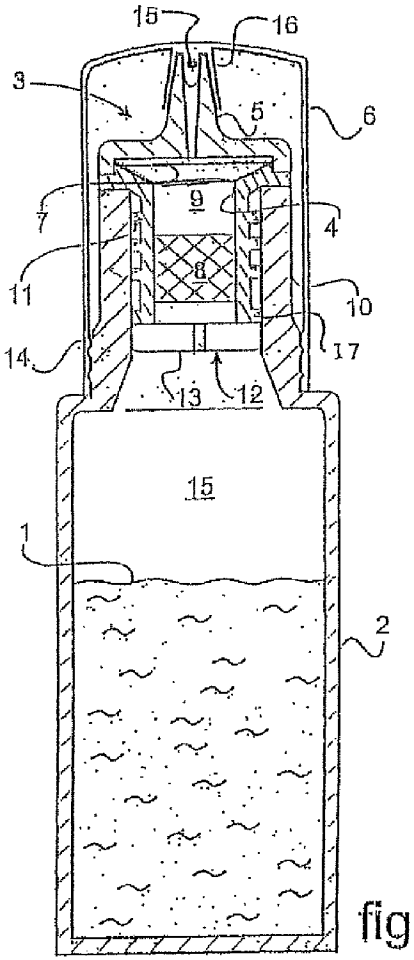
FIG. 1 and FIG. 2 are diagrams in axial section illustrating a container for packaging a liquid according to respective variants of embodiment of the present invention.
Figure 1:
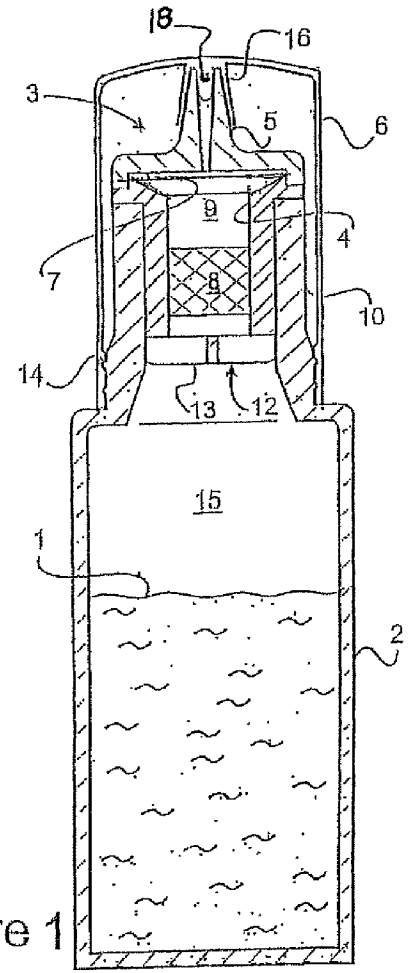

The body 4 is partly assembled inside the neck 10 of the container by forcible push-fitting. According to the various variants illustrated in FIG. 1 and FIG. 2, this push-fit is achieved either directly by close contact between the exterior surface of the body 4 and the interior surface of the neck 10, as illustrated in FIG. 1 or, and preferably, via O-rings 11 formed at the periphery of the body 4, as illustrated in FIG. 2. The preferred presence of a centring member 12 formed at the base of the body 4 to facilitate its introduction into the neck 10 of the container will be noted in these exemplary embodiments. The centring member 12 illustrated by way of example consists overall of radial fins 13 for joining, by push-fitting, the body 4 to the neck 10, the fins 13 delimiting open sectors between them, these being more particularly visible in FIG. 3.

Finally, the variants illustrated disclose the assembly of the cap 6 onto the neck 10 of the container by screw-fastening, using collaborating reliefs 14. To facilitate the screwing of the cap 6 onto the container and enhance the sealing between the two, the cap 6 comprises a pip 18 penetrating the nozzle 5 of the dispensing head and a skirt 16 fitting over the nozzle.

The invention claimed is:

1. A container for packaging a liquid that is to be dispensed drop by drop, said container comprising:

a reservoir defining a volume (15) suitable for storing liquid, said reservoir having walls (2) that are reversibly elastically deformable whereby liquid (1) in said volume (15) can be discharged from said reservoir by application of pressure exerted against said walls (2) and said container can return spontaneously to its initial shape, after liquid (1) is delivered, through intake of air into said container;

a neck (10) connected to said reservoir;

a dispensing head (3) comprising a hollowed-out body (4) having a nozzle (5) for delivering liquid (1) out from said volume, a hydrophobic microporous pad (8) placed within said body (4) between said nozzle (5) and said reservoir, and an antibacterial filter membrane (7) positioned upstream of said nozzle (5) between said nozzle (5) and said pad (8), said body (4) being assembled irreversibly inside said neck (10) of said container, wherein said filter membrane (7) is partially hydrophilic to allow liquid to pass through said filter membrane under the effect of raised pressure created in said container by pressing of said walls, and wherein said filter membrane is partially hydrophobic to allow air to pass through said filter membrane under the effect of the depression created in said container when pressure exerted against said walls has been released, said container further comprising a removable cap (6) for sealing said nozzle (5) wherein said cap (6), in combination with said hydrophobic microporous pad (8) and said filter membrane (7), impedes spontaneous flow of liquid (1) towards said nozzle (5) from the volume (15) suitable for storing liquid so that:

(a) spontaneous passage of liquid (1) through said microporous pad (8) is prevented when said cap (6) is sealing said nozzle (5), (b) free flow of liquid (1) from said volume (15) suitable for storing liquid and through said hydrophobic microporous pad (8) is allowed when said nozzle (5) is uncovered, and (c) air is permitted to be drawn in through said hydrophobic microporous pad (8) to pass into said volume (15), after liquid (1) is delivered, by elastic return of said container to its initial shape.

2. A container for packaging a liquid according to claim 1, wherein said microporous pad (8) is made of polyethylene, and the microporous structure of said pad permits liquid to pass through said pad under the effect of a pressure differential brought about by pressure exerted against said walls of said container.

3. A container for packaging a liquid according to claim 1, wherein said microporous pad (8) has microducts having a mean pore diameter, and the mean pore diameter of said microducts ranges between 0.3 and 10 microns.

4. A container for packaging a liquid according to claim 1, wherein said dispensing head further comprises an intermediate chamber (9) for evening out delivery of liquid, wherein said intermediate chamber is formed between said microporous pad (8) and said filter membrane (7).

5. A container for packaging a liquid according to claim 4, wherein said intermediate chamber has sufficient volume to collect at least one drop of liquid that would be dispensed during delivery operation.

6. A container for packaging a liquid according to claim 4, wherein said intermediate chamber extends over the entire surface of said microporous pad in sufficient volume to constitute a reserve of air which, when said nozzle (5) is sealed by said cap (6), exerts pressure preventing liquid (1) from passing through said microporous pad (8).

7. A container for packaging a liquid according to claim 4, wherein said intermediate chamber (9) extends over the entire surface of said filter membrane at a sufficient axial distance that said intermediate chamber can accommodate liquid that has not yet crossed said filter membrane when pressure ceases to be exerted on said walls of said container and to enhance the ability of said filter membrane to dry out between two deliveries of liquid.

8. A container for packaging a liquid according to claim 1, wherein said body (4) is assembled inside said neck (10) of said container as a push-fit with close contact.

9. A container for packaging a liquid according to claim 8, wherein said body (4) is elastically deformable so that said body (4) can be forcibly introduced into said neck (10) of said container, and a centring member (12) is formed at the base of said body (4) so as to facilitate forcible introduction of said body (4) into said neck.

10. A container for packaging a liquid according to claim 9, wherein said centring member (12) consists of radial fins (13) for joining, by push-fitting, said body (4) of said dispensing head to said neck (10) of said container, said fins (13) defining open sectors between them.

11. A container for packaging a liquid according to claim 8, wherein the exterior surface of said body (4) of said dispensing head is equipped with at least one O-ring (11) originating from said body (4) and which forms an integral part of said body (4).

12. A container for packaging a liquid according to claim 10, wherein said body (4) of said dispensing head is obtained by moulding under conditions such that a ring (17), resulting from the parting line of the mould, is situated at the distal end of said body (4), at the boundary where said centring member (12) is attached, to enhance the obtainment of a sealed connection between said dispensing head and said container.

13. A container for packaging a liquid according to claim 1, wherein said removable cap (6) is screwed onto said container.

14. A container for packaging a liquid according to claim 13, wherein said cap (6) comprises a combination of sealing members, said sealing members comprising the combination of a pip (18) that penetrates into said nozzle (5) of said dispensing head and a skirt (16) that fits over said nozzle (5).

15. A container for packaging a liquid according to claim 11, wherein the exterior surface of said body (4) of said dispensing head is equipped with a plurality of axially distributed O-rings (11).

16. A container for packaging a liquid according to claim 1, wherein the pores of said antibacterial filter membrane (7) have a pore diameter of ranging between 0.1 and 0.2 microns.

17. A container for packaging a liquid according to claim 1, wherein said filter membrane (7) is made from a polyamide or polyether sulphone resin, and the structure of the membrane is modified to provide the membrane with a partially hydrophobic nature 18. A container for packaging a liquid according to claim 1 , wherein 20 to 50 percent of the surface of said filter membrane (7) that is wetted during delivery of liquid is modified so as to have a hydrophobic nature.

19. A container for packaging a liquid according to claim 1, wherein said dispensing head further comprises an intermediate chamber (9) for evening out delivery of liquid, wherein said intermediate chamber is formed between said microporous pad (8) and said filter membrane (7).

20. A container for packaging a liquid according to claim 19, wherein said body (4) is assembled inside said neck (10) of said container as a push-fit with close contact, said body (4) is elastically deformable so that said body (4) can be forcibly introduced into said neck (10) of said container, and a centring member (12) is formed at the base of said body (4) so as to facilitate forcible introduction of said body (4) into said neck, said centring member (12) consisting of radial fins (13) for joining, by push-fitting, said body (4) of said dispensing head to said neck (10) of said container, said fins (13) defining open sectors between them.

21. A method for dispending a liquid drop by drop from a container, said method comprising: providing a container according to claim 1 wherein said volume of said reservoir contains a liquid, removing cap (6) from said container; applying pressure to the walls (2) of said container to dispense a dose of said liquid from said nozzle of said container; and, after said dose of said liquid (1) is dispensed, removing the applied pressure from the walls of said container whereby said container returns spontaneously to its initial shape by the intake of air into said container through said nozzle.

22. A method for dispending a liquid drop by drop from a container, said method comprising: providing a container according to claim 20 wherein said volume of said reservoir contains a liquid, removing said cap (6) from said container;

applying pressure to the cylindrical wall (2) of said container to dispense a dose of said liquid from said nozzle of said container; and, after said dose of said liquid (1) is dispensed, removing the applied pressure from the cylindrical wall (2) of said container whereby said container returns spontaneously to its initial shape by the intake of air into said container through said nozzle.

23. A container for packaging a liquid that is to be dispensed drop by drop, said container comprising:

a reservoir defining a volume (15) suitable for storing liquid, said reservoir having a straight cylindrical wall, a base at one end of said cylindrical wall, and a neck (10) connected to the other end of said cylindrical wall;

a dispensing head (3) positioned within said neck (10) of said reservoir, said dispensing head (3) comprising a hollowed-out body (4) and a nozzle (5) for delivering liquid (1), said dispensing head (3) further comprising a hydrophobic microporous pad (8) positioned between said nozzle (5) and said reservoir, and an antibacterial filter membrane (7) positioned upstream of said nozzle (5) between said nozzle (5) and said pad (8), and said body (4) of said dispensing head (3) is assembled irreversibly within said neck (10) of said reservoir;

wherein said filter membrane (7) is partially hydrophilic to allow liquid to pass through said filter membrane under the effect of raised pressure created in said container by pressing of said walls, and wherein said filter membrane is partially hydrophobic to allow air to pass through said filter membrane under the effect of the depression created in said container when pressure exerted against said walls has been released; and a removable cap (6) for sealing said nozzle (5) wherein said cap (6), in combination with said hydrophobic microporous pad (8) and said filter membrane (7), impedes spontaneous flow of liquid (1) towards said nozzle (5) from the volume (15) suitable for storing liquid;

wherein said cylindrical wall is reversibly elastically deformable whereby liquid (1) in said volume (15) can be discharged from said reservoir by application of pressure exerted against said cylindrical wall (2) and said reservoir can return spontaneously to its initial shape, liquid (1) is delivered, through the intake of air into said reservoir through said nozzle (5); and wherein, when said cap (6) is sealing said nozzle (5), said cap (6) prevents spontaneous passage of liquid (1) through said microporous pad (8); when said cap (6) is not sealing said nozzle (5), free flow of liquid (1) from said volume (15) suitable for storing liquid and through said hydrophobic microporous pad (8) is permitted; and when said cap (6) is not sealing said nozzle (5), by elastic return of the walls of said reservoir to their initial shape air is permitted to be drawn in through said nozzle (5), through said hydrophobic microporous pad (8), and into said volume (15) after a dose of liquid (1) has been delivered.

24. A container for packaging a liquid that is to be dispensed drop by drop, said container comprising:

a reservoir defining a volume (15) suitable for storing liquid, said reservoir having walls (2) that are reversibly elastically deformable whereby liquid (1) in said volume (15) can be discharged from said reservoir by application of pressure exerted against said walls (2) and said container can return spontaneously to its initial shape, after liquid (1) is delivered, through intake of air into said container;

a neck (10) connected to said reservoir;

a dispensing head (3) comprising a hollowed-out body (4) having a nozzle (5) for delivering liquid (1) out from said volume, a hydrophobic microporous pad (8) placed between said nozzle (5) and said reservoir, said body (4) being assembled irreversibly inside said neck (10) of said container as a push-fit with close contact, said body (4) being elastically deformable so that said body (4) can be forcibly introduced into said neck (10) of said container, and said body (4) further comprising a centring member (12) formed at the base of said body (4) so as to facilitate forcible introduction of said body (4) into said neck (10), said container further comprising a removable cap (6) for sealing said nozzle (5) wherein said cap (6), in combination with said hydrophobic microporous pad (8), impedes spontaneous flow of liquid (1) towards said nozzle (5) from the volume (15) suitable for storing liquid so that:

(a) spontaneous passage of liquid (1) through said microporous pad (8) is prevented when said cap (6) is sealing said nozzle (5), (b) free flow of liquid (1) from said volume (15) suitable for storing liquid and through said hydrophobic microporous pad (8) is allowed when said nozzle (5) is uncovered, and (c) air is permitted to be drawn in through said hydrophobic microporous pad (8) to pass into said volume (15), after liquid (1) is delivered, by elastic return of said container to its initial shape.

* * * * *